US006689039B2

(12) United States Patent
Kunreuther

(10) Patent No.: US 6,689,039 B2
(45) Date of Patent: Feb. 10, 2004

(54) AUTOMATIC TAG ATTACHING APPARATUS WITH PIVOTALLY MOUNTED TAG FEED PLATE

(76) Inventor: Steven Kunreuther, 285 Central Park West, New York, NY (US) 10024

( * ) Notice: Subject to any disclaimer, the term of this patent is extended or adjusted under 35 U.S.C. 154(b) by 0 days.

(21) Appl. No.: 10/190,024

(22) Filed: Jul. 8, 2002

(65) Prior Publication Data

US 2004/0005979 A1 Jan. 8, 2004

(51) Int. Cl.[7] ..... B31D 1/02; B27F 7/02

(52) U.S. Cl. ..... 493/376; 227/4

(58) Field of Search ..... 493/374, 375, 493/379, 372, 376; 53/415, 392, 394, 384; 227/67, 71, 4, 5, 43, 6

(56) References Cited

U.S. PATENT DOCUMENTS

| | | | | |
|---|---|---|---|---|
| 3,896,713 A | | 7/1975 | Mato | |
| 4,235,161 A | * | 11/1980 | Kunreuther | 493/376 |
| 4,237,779 A | | 12/1980 | Kunreuther | |
| 4,288,017 A | | 9/1981 | Russell | |
| 4,589,583 A | | 5/1986 | Kunreuther et al. | |
| 4,718,158 A | | 1/1988 | Block | |
| 4,781,318 A | | 11/1988 | Meyers | |
| 4,789,091 A | * | 12/1988 | Randolph | 227/67 |
| 5,199,338 A | * | 4/1993 | Schorn et al. | 83/13 |
| 5,608,274 A | * | 3/1997 | Cipolla et al. | 307/119 |

OTHER PUBLICATIONS

Advertising Sheets TTX 950 Tag and Label Printer Advertising Sheets TTX 300/TTX 300 Off–Line Tag and Label Print.

* cited by examiner

*Primary Examiner*—John Sipos
*Assistant Examiner*—Paul Durand
(74) *Attorney, Agent, or Firm*—Robert L. Epstein; Harold James; James & Franklin, LLP

(57) ABSTRACT

Apparatus for automatically attaching tags to articles employs a simplified tag feed mechanism in the form of a pivotally mounted spring-loaded tag feed plate. The plate receives the printed tag from the tag dispenser. The plate, with its tag, and the article to be tagged, are moved together, either manually or by action of a pneumatic cylinder, toward an attaching device such that the needle penetrates the article and the tag at the same time. The attacher is actuated to dispense a fastener through the needle. The spring-loading of the plate then urges the plate away from the needle, allowing the article with its anchored tag to be removed, once the plate clears the needle. The tag dispenser is then actuated to dispense the next printed tag.

20 Claims, 7 Drawing Sheets

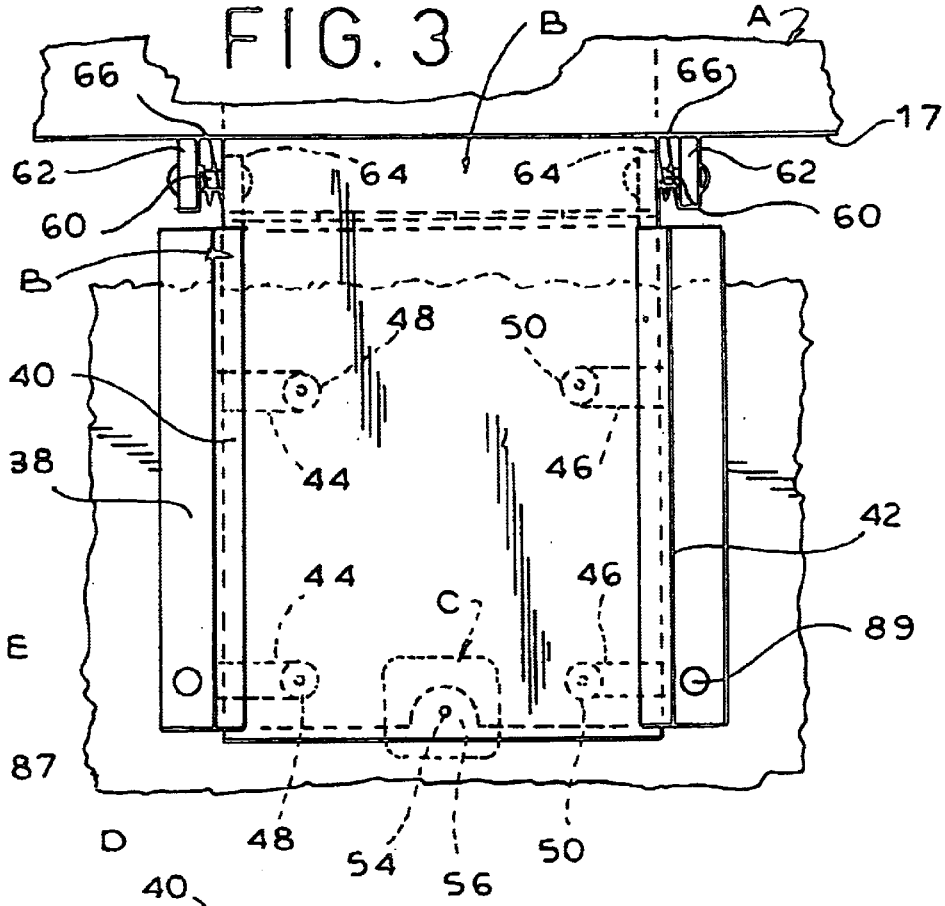
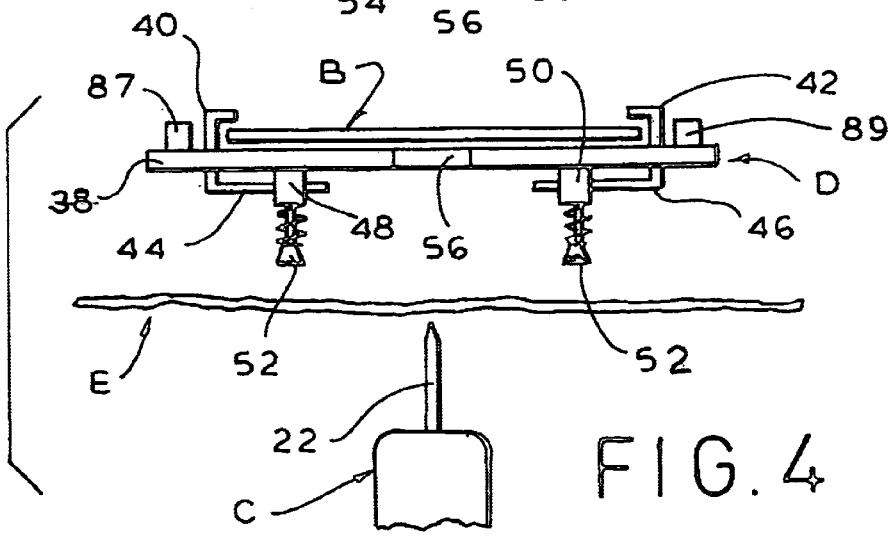
FIG. 4

AUTOMATIC TAG ATTACHING APPARATUS WITH PIVOTALLY MOUNTED TAG FEED PLATE

The present invention relates to apparatus for automatically attaching preprinted tags of various types to articles and more particularly to an improved apparatus for automatically attaching tags, designed for use with a tag dispensing mechanism such as a tag printer, which includes a simplified tag feed mechanism.

Tags of various types are utilized to label large quantities of many different types of articles, such as clothing. One popular means of attaching tags to articles is by using plastic fasteners. Such fasteners are provided with a T-bar at one end. The T-bar is connected to an enlarged paddle, located at the other end of the fastener, by a thin, flexible filament. The filament is stretched during the fabrication process to give it a high tensile strength.

To attach the tag to an article, a device with a gun-like housing having a protruding hollow slotted metal needle is utilized. The needle is inserted through a pre-punched opening in the tag and penetrates the article to be tagged. The T-bar end of the fastener is then ejected through the needle, such that the T-bar is situated on one side of the tag and article, with the enlarged paddle end on the other side, anchoring the tag to the article.

Hand held tag attaching devices of this type are used widely and commercially available from a number of suppliers. Those devices may be manually operated or power driven, either electrically or pneumatically. Table mounted versions are also commonly utilized, sometimes in conjunction with automatic tag feeding mechanisms which feed separated preprinted tags from a stack to the fastener dispensing device. Circuitry for controlling the tag feed and fastener dispensing operations is provided. See, for example U.S. Pat. No. 3,896,713 entitled "Top-Feeding Automatic Tag-Attaching Machine" issued to Mato on Jul. 29, 1975; U.S. Pat. No. 4,235,161 entitled "Automatic Tag Attaching Apparatus" issued to Kunreuther on Nov. 25, 1980; U.S. Pat. No. 4,718,158 entitled "Automatic Tagging Apparatus and Method Therefor" issued to Charles Block on Jan. 12, 1988; and U.S. Pat. No. 4,781,318 entitled "Tagging Apparatus" issued to Ronald Meyers on Nov. 1, 1988.

Most automatic tagging mechanisms available currently, such as the first three patents mentioned in the previous paragraph, employ a tag feed system which utilizes a pneumatically driven reciprocating slide mechanism. The slide moves preprinted tags, one at a time, from a stack in a hopper to a position where the pre-punched opening in the tag is aligned with the needle. In the Mato and Block mechanisms, the device and hence the needle is advanced toward the tag to insert the needle through the tag opening. In the Kunreuther machine, the attacher is fixed and tag is placed over the needle by moving the slide towards the needle after the tag is aligned.

Another automatic tagging mechanism utilizes a fixed tag attaching device like that of Kunreuther, but employs a moveable suction arm to engage the tag and place it on the needle. The arm carries a suction cup connected to a vacuum. The arm engages a tag in the hopper and transports the tag to the attacher. See U.S. Pat. No. 4,781,318 mentioned above. In the Meyers' apparatus, the vacuum arm is moved thorough a sinuous path that ends in a path section which is parallel to needle of the tag attaching device in order to place the tag over the needle.

The above mentioned automatic tag feed systems require precise adjustment of the vertical and horizontal position of the tag hopper relative to the tag feed means. This is because the opening in the tag is relatively small and the tag must be positioned such that the tag opening aligns exactly with the needle. Because of this, the set up of the machine is time consuming. Each time different size tags are used, readjustment of the hopper position is necessary, requiring considerable machine down time.

In the apparatus with vacuum-type transport means, vacuum as well as electrical power are needed. Further, in a hostile environment, it has been found that tag feeders of this type do not always operate reliably.

An improved vacuum feed mechanism for an automatic tag attaching apparatus is described in co-pending U.S. patent application Ser. No. 10/073,089, filed Feb. 12, 2002, entitled "Improved Automatic Tag Attaching Apparatus". That tag feed mechanism has a vacuum arm that moves an engaged tag through a simplified path of travel onto a stationary tag support platform. The attacher with its needle is then advanced toward the tag support platform to insert the needle through the tag opening. However, tag hopper positioning is still critical so the hopper is designed to be independently position adjustable in horizontal and vertical directions. A laser light is used to facilitate positioning of the hopper such that the tag is placed on the tag support platform with the opening in alignment with the needle.

Only pre-printed, separated tags can be utilized in systems which feed tags from a stack. In those systems, it is not possible to employ a conventional thermal transfer printer, designed to print tags as needed.

Instead of feeding separate preprinted tags from a stack, some automatic tagging mechanisms are capable of feeding end-to-end connected preprinted tags from a supply roll. However, those machines have the drawback of requiring an automatic cutter or knife to cut the attached tag from the next tag in sequence, before the tagged article can be removed from the machine.

Although using a knife or cutter with sharp blades results in a clean, straight cut, the blades must be continually sharpened. Further, such cutting mechanisms are complicated and may be hazardous to the operator.

Co-pending U.S. patent application Ser. No. 10/059,066, filed Jan. 30, 2002, entitled "Hangtags For Use In An Automatic Attaching Apparatus" discloses an invention that eliminates the necessity of using an automatic cutter in an automatic tag attaching system where the hangtags are connected end-to-end and supplied on a continuous roll. That system overcomes the positioning problems related to feeding tags from a stack. No vacuum or slide tag transfer mechanisms are required. This is accomplished through the use of hangtags that are connected together in a unique way which permits them to be manually separated.

In that system, the hangtags are removed from the supply roll in a continuous strip. The hangtags are connected end-to-end by connecting elements. The lead hangtag is guided into alignment with the attacher needle and attached to the article by the fastener. The next tag in sequence is held while the attached hangtag is separated by simply pulling the tagged article away from the apparatus. In one embodiment, some of the connecting elements between the attached hangtag and the held hangtag are automatically severed, prior to removal of the attached hangtag, making remnoval of the attached hangtag easier. This hangtag connection system permits the hangtags to be used with a conventional thermal transfer printer that prints blank tags as required, without a cutter. The hangtag can be used with or without an automatic attaching device.

The connecting elements disclosed in that patent application are formed so that they can be severed simultaneously by a pull force transferred through the anchored fastener. That force is directed perpendicular to the hangtag ends. By making the portion of the hangtag surrounding the pre-punched fastener receiving opening stronger than the force necessary to simultaneously sever the connecting elements, the hangtag attached to the article by the fastener can be manually separated from the next hangtag by simply removing the article from the tag attaching apparatus by pulling in a direction perpendicular to the hangtag end. This permits the entire tag printing and attaching processes to be fully automated, utilizing hangtags supplied on a continuous roll, without the necessity of an automatic knife or cutter.

While the system described in application Ser. No. 10/059,066 is a great improvement over systems which feed tags from a stack or which require automatic cutters or knives, it still is somewhat complex, having several moving parts and hence being relatively expensive to manufacture. There is therefore a need for a simpler, less expensive tag feed mechanism which can be used with tags which are connected end-to-end and supplied on a continuous roll.

Further, in that apparatus, and in machines like that disclosed in Block U.S. Pat. No. 4,718,158, the tag is fed to a plate which is situated between the article to be tagged and the attacher needle. No matter how thin the tag and plate are, they may interfere with the proper placement of the article relative to the needle.

In those mechanisms, there is a gap into which the article must be situated before it is penetrated by the needle. If the gap is too large, there is the possibility of the operator getting a finger caught in the mechanism. If the gap is too small, large, thick or bulky, articles may not fit into the machine.

In many cases, companies use what is called "an integrated tag" in which brand identification and/or other text is printed on the front surface of the tag and a barcode is located on the rear. In the machine of application Ser. No. 10/059,066, it is only possible to place the barcode on the front of the tag. This is because the garment is placed underneath the machine and the fastener first goes through the tag with the barcode showing and then through the product.

In all conventional automatic tag attaching machines, the tag is placed over the needle. Then the article is penetrated by the needle. Hence, two separate movements are required, one to place the tag on the needle and a second to cause the needle to penetrate the article. My apparatus greatly simplifies the automatic attaching procedure by moving the tag and the article onto the needle in a single motion.

The present invention uses a conventional tag attacher, in which fasteners are supplied on a roll, a conventional computer controlled thermal printer and tags connected together and supplied on a continuous roll, as disclosed in application Ser. No. 10/059,066. The complex reciprocating slide or vacuum arm tag feed mechanisms of prior machines are replaced by a simple, pivotally mounted spring-loaded tag feed plate that receives the tag as it is dispensed and supports the tag in alignment with the attacher needle. The operator places the article to be tagged adjacent the plate and pushes the plate with the received tag, and article, down over the needle such that the tag and article are placed on the needle at the same time. After the plate reaches a position where the tag and article are both penetrated by the needle, the attacher is actuated to dispense the fastener.

Spring-loaded support plates have been used previously with stationary fastener attachers, see U.S. Pat. No. 4,237,779, issued Dec. 9, 1980, entitled "Automatic Attaching Apparatus". However, the automatic attaching apparatus disclosed in that patent is designed specifically to attach headers to soft goods and therefore lacks the capability for feeding labels into alignment with the needle.

Plates that are mechanically moved into alignment with the needle of a stationary attacher are also known, see, for example, U.S. Pat. No. 4,589,583, issued May 20, 1986, entitled "Automatic Hook Attaching Apparatus". That apparatus is designed for attaching plastic hooks to merchandise for purposes of display. In that apparatus, the hooks are supplied in a stack. The hooks are removed from the stack, one at a time, by a slide. The side is aligned with the needle using a cam and cam follower arrangement. There is no capability for feeding tags, much less tags that are connected end-to-end and supplied on a roll. The apparatus cannot be used in conjunction with a tag printer.

In the present invention, pivotally mounting the tag feed plate greatly simplifies the tag feed mechanism. In addition, mounting the tag feed plate in this manner provides the operator with better control over the operation of the apparatus because the plate, with the tag and article to be tagged, must be pivoted to a predetermined position before the attacher can be actuated to dispense the fastener.

To complete the tagging process successfully, it is most important that the article be fully seated over the needle. In order to accomplish that, the article must be- held taught as it is placed over the needle. My apparatus includes two different mechanisms for stretching the article to hold it taught as it is placed over the needle. Different mechanisms are provided depending upon whether the article is above or below the plate which receives and supports the tag.

Because the present invention utilizes a much simpler tag feed mechanism, most of the moving parts of the conventional feed mechanisms are eliminated, as is the necessity for moving the tag attacher relative to the feed plate. It provides more secure attaching of the tag because the tag and article are always completely seated on the needle. There is no limitation in the size of the gap between the feed plate and needle. Further, it permits tagging on the rear side of the tag.

It is, therefore, a prime object of the present invention to provide an automatic tag attaching apparatus with a simplified tag feed mechanism.

It is another object of the present invention to provide an automatic tag attaching apparatus wherein the tag and article are placed over the needle together, in a single, pivotal motion.

It is another object of the present invention to provide an automatic tag attaching apparatus that utilizes a simple, pivotally mounted tag feed plate.

It is another object of the present invention to provide an automatic tag attaching apparatus with a pivotally mounted tag feed plate that includes means for automatically pivoting the tag feed plate to place the tag and the article over the attacher needle.

It is another object of the present invention to provide an automatic tag attaching apparatus that is designed to be used in conjunction with a conventional tag printer.

It is another object of the present invention to provide an automatic tag attaching apparatus that includes mechanisms for holding the article taught as it is penetrated by the attacher needle.

It is another object of the present invention to provide an automatic tag attaching apparatus that is safer to use because the attacher is in a fixed position and need not be moved to place the attacher needle through the opening in the tag.

It is another object of the present invention to provide an automatic tag attaching apparatus which can be easily adjusted to accommodate different size tags.

It is another object of the present invention to provide an automatic tag attaching apparatus with a pivotally mounted tag feed plate which includes means for adjusting the position of the attacher relative to the tag feed plate.

In accordance with one aspect of the present invention, automatic apparatus for attaching a tag to an article is provided including a tag attacher with a hollow needle through which a fastener is dispensed, upon actuation of the attacher. Pivotally mounted means are provided for receiving and supporting the tag. The article to which the tag is to be attached is situated adjacent the tag receiving means. The tag receiving means, tag and article are moved between a first position, wherein the tag and article are aligned with but spaced from the attacher needle, and a second position, wherein the tag and article are positioned on the attacher needle, prior to actuation of the attacher.

Means are provided for spring-loading the tag receiving means towards the first position. Means are also provided for dispensing tags, one at a time, to the tag receiving means. The tag dispensing means may be a tag printing means such as a computer controlled thermal printer.

The apparatus may include means for moving the tag receiving means toward the second position. Means for actuating the tag receiving means moving means may be included. Means for actuating the tag dispensing means to dispense a tag may also be included.

The first position of the tag receiving means may be in a plane which forms an acute angle with a plane substantially perpendicular to the needle. Alternatively, the first position of the tag receiving means may be in a plane substantially perpendicular to the needle. In either case, the second position of the tag receiving means is in a plane which forms an acute angle with the plane of the first position.

The tag printing means has a surface proximate the location where the tags are dispensed. The tag receiving means mounting means is situated on that surface.

The tag printing means includes means for receiving a continuous roll of tags to be printed. The tags are connected together end-to-end. Preferably, means are provided for connecting the tags to each other such that the tags are separable without cutting.

The apparatus further includes means for holding the article taught as it is placed on the needle. The tag receiving means includes a tag receiving section. In the embodiment, where the article is located above the tag receiving means, the holding means includes article stretching means situated proximate to and moveable away from the tag receiving section such that the article is stretched over the tag receiving section. The stretching means includes first and second parts, situated proximate the opposite sides of the tag receiving section. The parts are -moveable away from the tag receiving section to stretch the article over the tag receiving section.

In a second embodiment, the article is located below the tag receiving means. In this case, the article stretching means includes first and second recesses located on the tag receiving means, on opposite sides of the tag receiving section. A part having first and second protrusions is provided. The first and second protrusions are aligned with the first and second recesses, respectively. The part is situated proximate the attacher, with the first and second protrusions located on opposite sides of the needle.

The apparatus includes means for actuating the attacher. The attacher means actuating is located to sense the position of the tag receiving means such that the attacher is actuated to dispense a fastener as the tag receiving means approaches the second position.

In accordance with another aspect of the present invention, automatic tag attaching apparatus is provided including a tag attacher with a hollow needle through which a fastener is dispensed, upon actuation of the attacher. Means, are provided, for receiving a tag. Means are provided for pivotally mounting the tag receiving means for movement relative to the attacher needle between a first position, wherein the received tag is aligned with the attacher needle, and a second position, wherein the received tag is positioned on the attacher needle. Means for spring-loading the tag receiving means toward the first position are provided. The tag receiving means is moveable toward the second position, against the urging of the spring-loading means, to position the received tag on the needle, prior to actuation of the attacher.

The apparatus is designed for use with means for dispensing tags, one at a time, to the tag receiving means. The tag dispensing means can take the form of tag printing means, such as conventional computer controlled thermal printer.

The printing means has a surface proximate the place where the printed tags are dispensed. The tag receiving means mounting means is preferably situated on that surface.

The tag dispensing means includes means for receiving a roll of tags. The tags are connected end-to-end by means for connecting the tags to each other that permits the tags to be separated from each other without cutting.

The first position of the tag receiving means may be in a plane which forms an acute angle with a plane substantially perpendicular to the needle. Alternatively, the first position of the tag receiving means may be in a plane substantially perpendicular to the needle.

The apparatus is designed for use in attaching a tag to an article. The apparatus includes means for holding the article taught as it is placed on the needle. The article may be located above the tag receiving means. In that case, the tag receiving means comprises a tag receiving section. The holding means takes the form of article stretching means that is situated proximate to and moveable away from the tag receiving section, such that the article is stretched over the tag receiving section. The stretching means includes first and second parts, situated proximate the opposite sides of the tag receiving section.

In another embodiment, the article is located below the tag receiving means. In that case, the stretching means includes first and second recesses located on the tag receiving means, on opposite sides of the tag receiving section. A part is provided having first and second protrusions. The first and second protrusions are aligned with the first and second recesses, respectively. The part is situated proximate the attacher, with the first and second protrusions located on opposite sides of the needle.

The tag receiving means moving means actuating means includes switch means located on the tag receiving means. Preferably, the switch means comprises first and second spaced switches on the tag receiving means.

The apparatus comprises means for actuating the attacher. The attacher actuating means may be a switch located proximate the second position of the tag receiving means. In this way, the attacher is automatically actuated to dispense a fastener as the tag receiving means approaches the second position.

The tag dispensing means actuating means may be a switch located proximate the first position of the tag receiving means. The tag dispensing means is actuated to dispense a tag as the tag receiving means approaches the first position.

Alternatively, the tag dispensing means actuating means may be an optical sensor. The sensor detects the removal of a tag from the tag receiving means and actuates the tag dispensing means.

The apparatus may include means for adjusting the width of the tag receiving means. This permits the tag receiving means to accommodate different size tags.

The tags are provided with prepunched holes for receiving the attacher needle. Means are provided for adjusting the position of the attacher relative to the tag receiving means such that the hole in the received tag aligns with the needle, when the tag receiving means is in the first position.

In accordance with another aspect of the present invention, automatic tag attaching apparatus is provided including a tag attacher having a hollow needle through which a fastener is dispensed, upon actuation of the attacher. Means are provided dispensing tags, one at a time, as are means for receiving a tag as it is dispensed from the tag dispensing means. Means are provided for pivotally mounting the tag receiving means for movement relative to the attacher needle between a first position, wherein the received tag is aligned with the attacher needle, and a second position, wherein the received tag is positioned on the attacher needle.

Means are provided for spring-loading the tag receiving means towards the first position.

Means are provided for actuating the attacher to dispense a fastener.

Means are provided for moving the tag receiving means toward the second position. This moving means may take the form of a pneumatic cylinder.

The tag dispensing means includes tag printing means. The printing means may be a conventional computer controlled thermal printer.

The first position of the tag receiving means may be in a plane which forms an acute angle with a plane substantially perpendicular to the needle. Alternatively, the first position of the tag receiving means may be in a plane substantially perpendicular to the needle.

Means are provided for actuating the tag receiving means moving means. The tag receiving means moving means actuating means includes switch means located on the tag receiving means. The switch means preferably includes first and second spaced switches on the tag receiving means.

The attacher actuating means is a switch located proximate the second position of the tag receiving means. The switch automatically actuates the attacher to dispense a fastener when the tag receiving means approaches the second position.

Means are provided for actuating the tag dispensing means to dispense a tag. The dispensing means actuating means is located proximate the first position of the tag receiving means. The dispensing means is actuated to dispense a tag as the tag receiving means approaches the first position. Alternatively, an optical sensor may be used for this purpose.

Means are provided for adjusting the width of the tag receiving means to accommodate different size tags.

The tags have prepunched fastener receiving holes. Means are provided for adjusting the position of the attacher relative to the tag receiving means such that the hole in the received tag aligns with the attacher needle when the tag receiving means is in the first position.

In accordance with another aspect of the present invention, automatic tag attaching apparatus for use in attaching a tag to an article is provided. The apparatus includes a tag attacher having a hollow needle through which a fastener is dispensed, upon actuation of the attacher. Means are provided for dispensing tags, one at a time, as are means for receiving a tag as it is dispensed from the tag dispensing means. Means are provided for mounting the tag receiving means for movement relative to the attacher needle between a first position, wherein the received tag is aligned with the attacher needle, and a second position, wherein the received tag is positioned on the attacher needle. Means are provided for holding the article taught as it is placed over the needle. The tag receiving means is moveable toward the second position, to position the received tag and article on the needle, prior to actuation of the attacher.

The tag dispensing means includes tag printing means. The tag printing means may be a conventional computer controlled thermal printer.

In one preferred embodiment, the article is located above the tag receiving means. The tag receiving means includes a tag receiving section and the article holding means includes article stretching means. The article stretching means are situated proximate to and moveable away from the tag receiving section such that the article is stretched over the tag receiving section. These means comprise first and second parts, situated proximate the opposite sides of the tag receiving section. The parts are moveable away from the tag receiving section, such that the article is stretched over the tag receiving section.

In another preferred embodiment, the article is located below the tag receiving means. The article stretching means includes first and second recesses located on the tag receiving means, on opposite sides of the tag receiving section. A part is provided having first and second protrusions. The first and second protrusions are aligned with the first and second recesses, respectively. The part is situated proximate the attacher, with the first and second protrusions located on opposite sides of the needle.

Means are provided for actuating the attacher. The attacher actuating means is located proximate the second position of the tag receiving means such that the attacher is actuated to dispense a fastener as the tag receiving means approaches the second position.

The apparatus further comprises means for actuating the tag dispensing means to dispense a printed tag. The tag dispensing means actuating means is located proximate first position of the tag receiving means such that the tag dispensing means is actuated to dispense a tag when the tag receiving means approaches the first position. Alternatively, an optical sensor can be used for this purpose.

Means are provided for adjusting the width of the tag receiving means to accommodate different size tags.

The tags have prepunched holes for receiving the needle. Means are provided for adjusting the position of the attacher relative to the tag receiving means such that the hole in the received tag aligns with the attacher needle, when the tag receiving means is in the first position.

Means are provided for moving the tag receiving means. Means for actuating the tag receiving means moving means are also provided.

To these and such other objects which hereinafter appear, the present invention relates to automatic tag attaching apparatus with a pivotally mounted tag feed plate, as set forth in the following specification and recited in the annexed claims, taken together with the accompanying drawings, wherein like numerals refer to like parts and in which:

FIG. 3 is a top elevational view of one version of the tag feed plate of the first preferred embodiment;

FIG. 4 is a front view of the plate of FIG. 3;

The present invention relates to automatic apparatus for attaching tags to an article, such as an article of clothing. The invention is designed for use with a machine that dispenses a printed tag when actuated. Preferably, the machine is a conventional computer controlled tag and label printer, for example, a TTX 300 or TTX 450 Tag and Label Printer, available from Avery Dennison of Framingham, Massachusetts. However the present invention could be used with a machine which dispenses pre-printed tags or labels.

In either case, the tags or labels (for simplicity, in this specification, the word "tag" will be used to refer to any tag, label or similar product which can be printed upon and attached to an article) are connected end-to-end and supplied on a continuous roll. The tags are connected to each other by unique connecting elements that are designed to be separated manually, without a knife or cutter, by pulling one tag away from the next tag in sequence, while the next tag is held. In this case, the next tag in sequence is held by the internal mechanism of the tag dispenser, as is conventional for such machines. For detailed information regarding the tag connecting system, please refer to co-pending application Ser. No. 10/059,066, mentioned above.

The printed tag is attached to the article by a plastic fastener. The fastener is dispensed through the hollow needle of a tag attacher of conventional design, such as the System 1000 "Swiftacher", also available from Avery Dennison.

Figure 1:
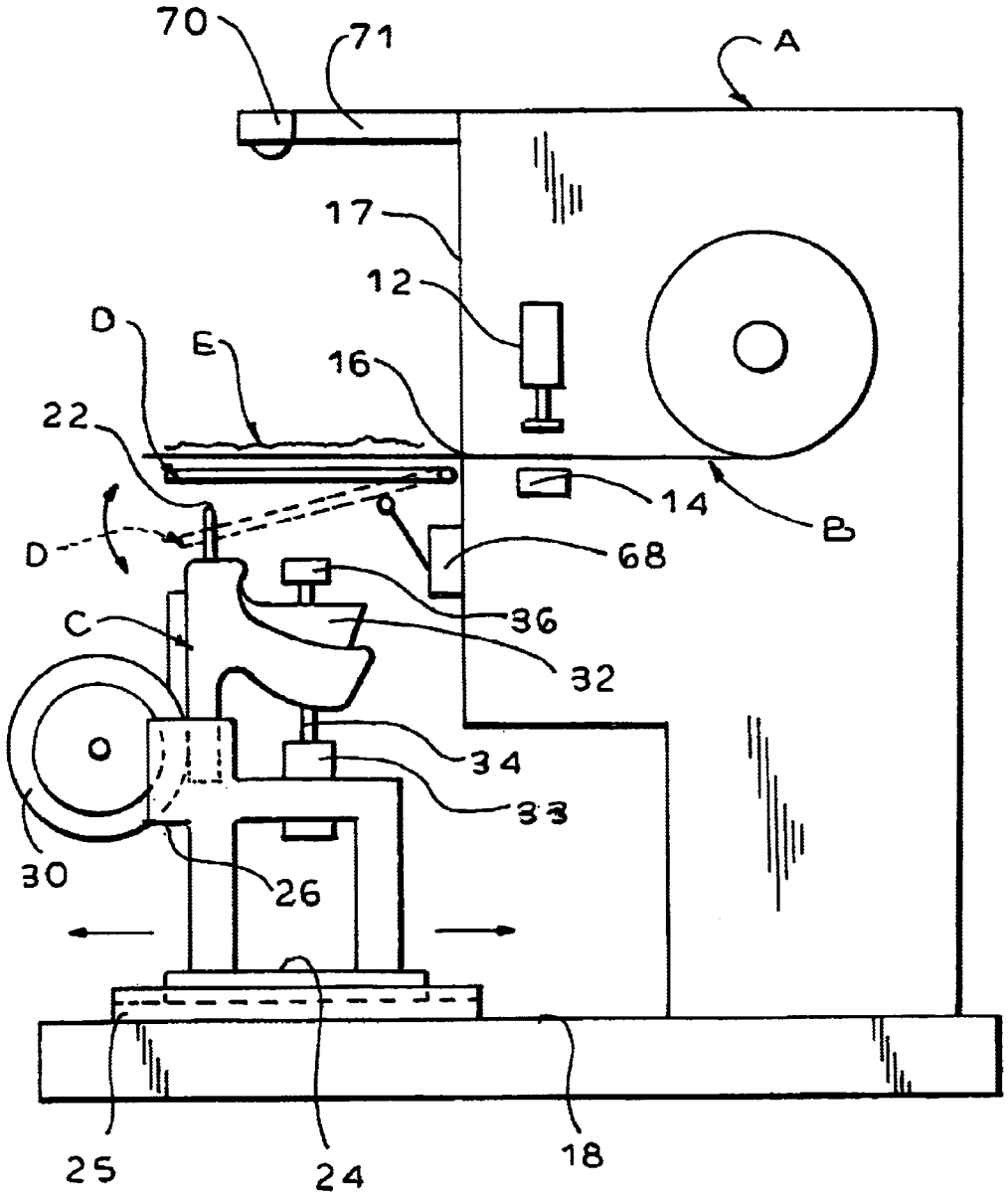
FIG. 1 is a side elevational view of a first preferred embodiment of the present invention.

As seen in FIG. 1, the present invention includes a mechanism, generally designated A, which dispenses printed tags, generally designed B, one at a time from a supply roll 10. In this case, tags B on roll 10 are preprinted. The tags pass through a holding stage, represented schematically by a pneumatic cylinder 12 with an extendable rod which acts against a stationary anvil 14. The holding stage securely holds the second tag in sequence, after the first tag is dispensed, but is disabled as a tag is being dispensed. Tags B are dispensed, one at a time, through a slot 16 on the front surface 17 of the housing of tag dispenser A.

Tag dispenser A is mounted on a work surface, such as a table top 18. Also mounted on table top 18 is the tag attacher, generally designated C.

Tag attacher C has a gun-like body with a hollow slotted metal needle 22 protruding from its front end. Attacher C is fixedly mounted to a platform 24 by bracket 26. Platform 24 and hence attacher C is position adjustable relative the surface of table top 18.

Tag attacher C is mounted on platform 24 by bracket 26 such that the attacher body is in a generally upright position with needle 22 parallel to the front surface 17 of the housing of tag dispenser. The tip of needle 22 is located slightly below the plane of slot 16.

Tag attacher C carries a supply of plastic fasteners in a roll 30. It includes a depressable trigger 32. Depression of the trigger causes the "T" bar end of a fastener to be dispensed through needle 22. After a fastener is dispensed, an additional fastener from roll 30 is automatically fed to the attacher.

A pneumatic cylinder 33, also mounted on platform 24, is provided with a retractable rod 34 which carries a part 36 for engaging trigger 32. Retraction of rod 34 depresses trigger 32 to cause attacher C to dispense a fastener through needle 22.

A tag feed guide plate, generally designated D, is pivotally mounted to the front surface 17 of housing of tag dispenser A, at a position slightly below slot 16. Plate D receives a tag as it is dispensed through slot 16.

Platform 24 which carries attacher C is moveable relative to table top 18 within an enlongated recess in block 25 which is fixed to the table top. Set screws (not shown) are loosened to permit the position of the bracket to be moved relative to block 25 to the desired position. The screws are then tightened to secure the bracket. This permits the position of attacher C, and hence needle 22, to be adjusted relative to plate D such that the needle is properly aligned with the prepunched hold in the tag B supported on plate D.

As best seen in FIGS. 3 and 4, plate D includes a base 38 which carries first and second oppositely oriented upside down "L" shaped tag guides 40, 42. Guides 40 and 42 are situated on sets of rods 44, 46, respectively, which are received in openings in blocks 48, 50, respectively, fixed to the bottom of base 38. Blocks 48, 50 are provided with set screws 52 (see FIG. 4) such that when screws 52 are loosened, rods 44, 46 can be moved relative to blocks 48, 50, to adjust the spacing between guides 40 and 42 such that plate D can easily accommodate tags of different sizes.

Each tag B has a prepunched hole 54 which receives the needle 22 and through which the fastener will extend after it is dispensed from needle 22. A semi-circular recess 56 on base 38 is situated to provide clearance for the needle and fastener.

Plate D is pivotally mounted to the front surface 17 of dispenser A by rods 60 which extend inwardly from spaced brackets 62 affixed to surface 17. Base 38 has a pair of spaced brackets 64 which engage rods 60. Helical springs 66 are situated around rods 60. The ends of each spring 60 are connected between each pair of brackets 62,64 such that plate D is spring-loaded toward its first position, shown in solid in FIGS. I and 2.

In FIG. 1 the first position of plate D is in a plane substantially perpendicular to and slightly above needle 22. Plate D can be manually moved by the operator, against the urging of springs 60, to a second position, as shown in phantom in FIG. 1. The second position is in a plane which makes an acute angle with the plane of the first position of the plate.

The operation of first preferred embodiment of the invention begins with tag dispenser A being actuated to dispense a single printed tag B through slot 16. The tag is received between guides 40 and 42 on plate D, with plate D in its first position. Tag B is supported on plate D with hole 54 of the tag in alignment with recess 56 in base 38 and with needle 22. The next tag in sequence is held by the holding mechanism of the tag dispenser, which in FIG. 1 takes the form of cylinder 12 and anvil 14.

The operator grasps the ends of the article to be tagged, generally designated E, in his or her hands and spreads the article over the tag on plate D. The operator then moves the article, plate D and the tag together, in a downward direction, toward the second position of plate D, against the urging of springs 66, such that needle 22 passes through hole 54 in the tag and penetrates article E at the same time. As plate D approaches the second position (shown in phantom in the drawings), the actuator of a switch 68, mounted on housing surface 17 below slot 16, is tripped.

Tripping switch 68 energizes cylinder 33 to retract rod 34 and depress trigger 36 of attacher C. This causes a fastener to be dispensed through needle 22. The fastener anchors the tag on plate D to article E. The operator releases the downward force on plate D which allows springs 66 to move plate D back to its first position. Once plate D clears needle 22, article E, and the attached tag B, are pulled away from plate D such that the attached tag separates from the next tag in sequence by severing the connecting elements between the tags. The tagged article is removed from the apparatus.

An optical "tag out" sensor 70, mounted on bracket 71 which extends from the housing of the tag dispenser, may be used to sense the removal of the tagged article. Sensor 70 consists of a light source and a photosensitive detector. The light source sends a beam of light toward plate D. Plate D has a surface which reflects the light back to the detector, when nothing is present above plate D. Thus, when the tag or article is present on plate D, no reflected light is sensed by the detector. However, when article E and the attached tag B are removed, the reflected beam is sensed by the detector. Sensor 70 then actuates the tag dispenser to dispense the next printed tag to plate D.

Figure 2:
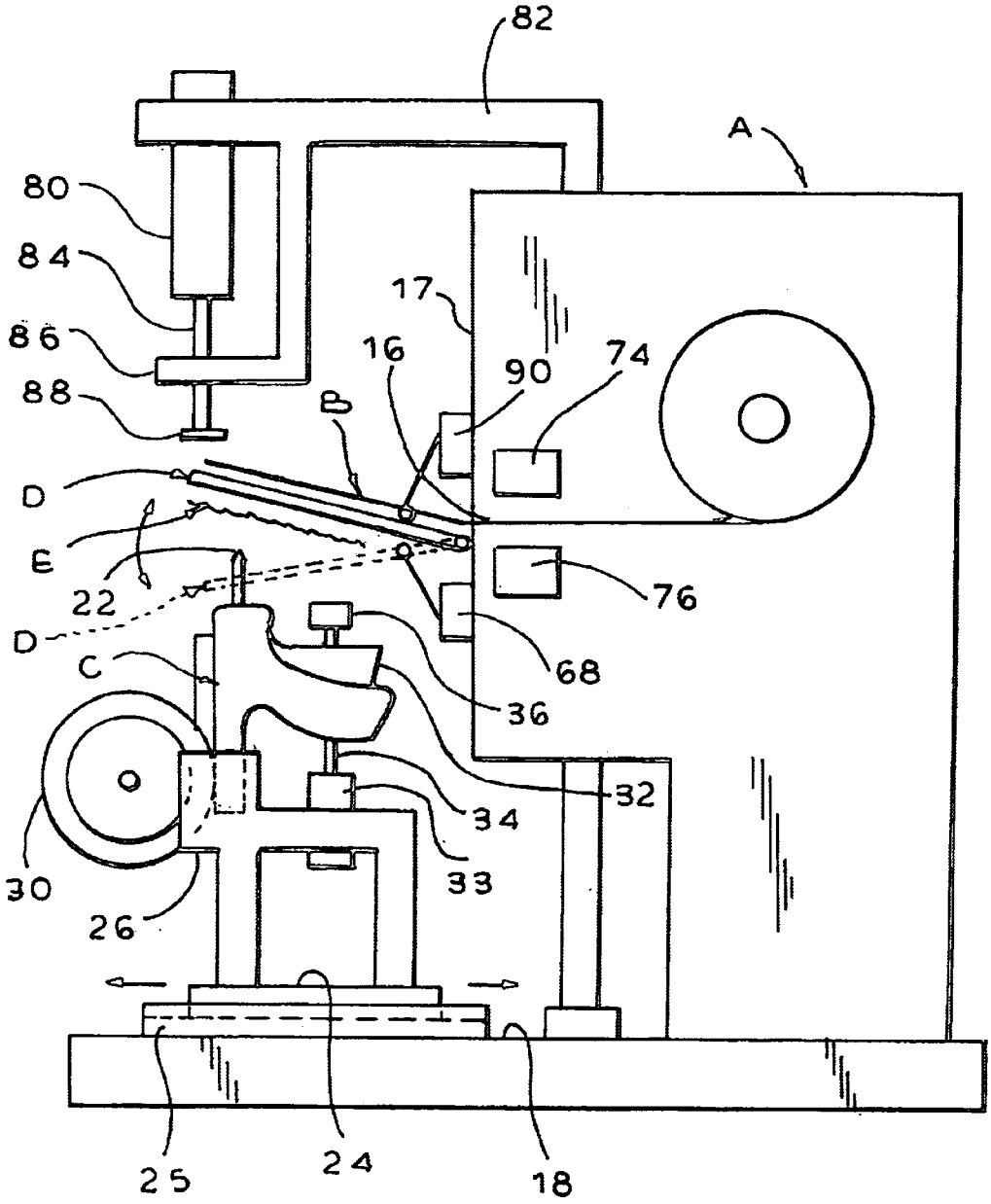
FIG. 2 is a side elevational view of a second preferred embodiment of the present invention.

FIG. 2 illustrates a second preferred embodiment of the invention. This embodiment is similar in most respects to the embodiment shown in FIG. 1. However, in this embodiment, article E is situated below plate D and tag dispenser A takes the form of a conventional computer controlled thermal tag printer. The printer is supplied with blank tags B from a roll 72. The tags B pass between print heads 74, 76 which serve to print each tag before it is dispensed and to hold the next tag in sequence.

Tag plate D, in this embodiment, has a first position which is at small acute angle above a plane perpendicular to needle 22. The second position of plate D is the same as in the first embodiment.

A pneumatic cylinder 80 is mounted by bracket 82 to the top of the housing of printer A. Cylinder 80 has a retractable rod 84 which extends through guide 86 on the lower section of bracket 82. The enlarged end 88 of rod 84 engages plate D and moves plate D (along with the tag B supported by the plate and the article beneath the plate) from its first position (shown in solid) to its second position (shown in phantom) as the rod extends such that the tag and article are simultaneously penetrated by the needle.

As seen in FIG. 3, base 38 carries a pair of pushbuttons 87, 89 on either side. Both pushbuttons 87, 89 must be depressed simultaneously to actuate cylinder 80 to extend rod 84. Requiring both pushbuttons to be depressed simultaneously insures that the operator's hands are out of the way before cylinder 80 is actuated.

Since article E is situated below plate D, as plate D and the tag supported by it are moved by cylinder 80 toward second position, needle 22 penetrates article E and passes through hole 54 on the tag B supported by plate D at the same time. As plate D approaches the second position, switch 68 actuates attacher C to dispense a fastener and cause cylinder 80 to retract rod 84, allowing springs 66 to move plate D back toward its first position and the operator to pull the tagged article away from the apparatus, severing the connecting elements between the anchored tag and the next tag in sequence.

As plate D approaches its first position, the actuator of a switch 90, located on the front surface 17 of printer A, is tripped. Switch 90 actuates printer A to print and dispense the next tag B to plate D.

Figure 5:
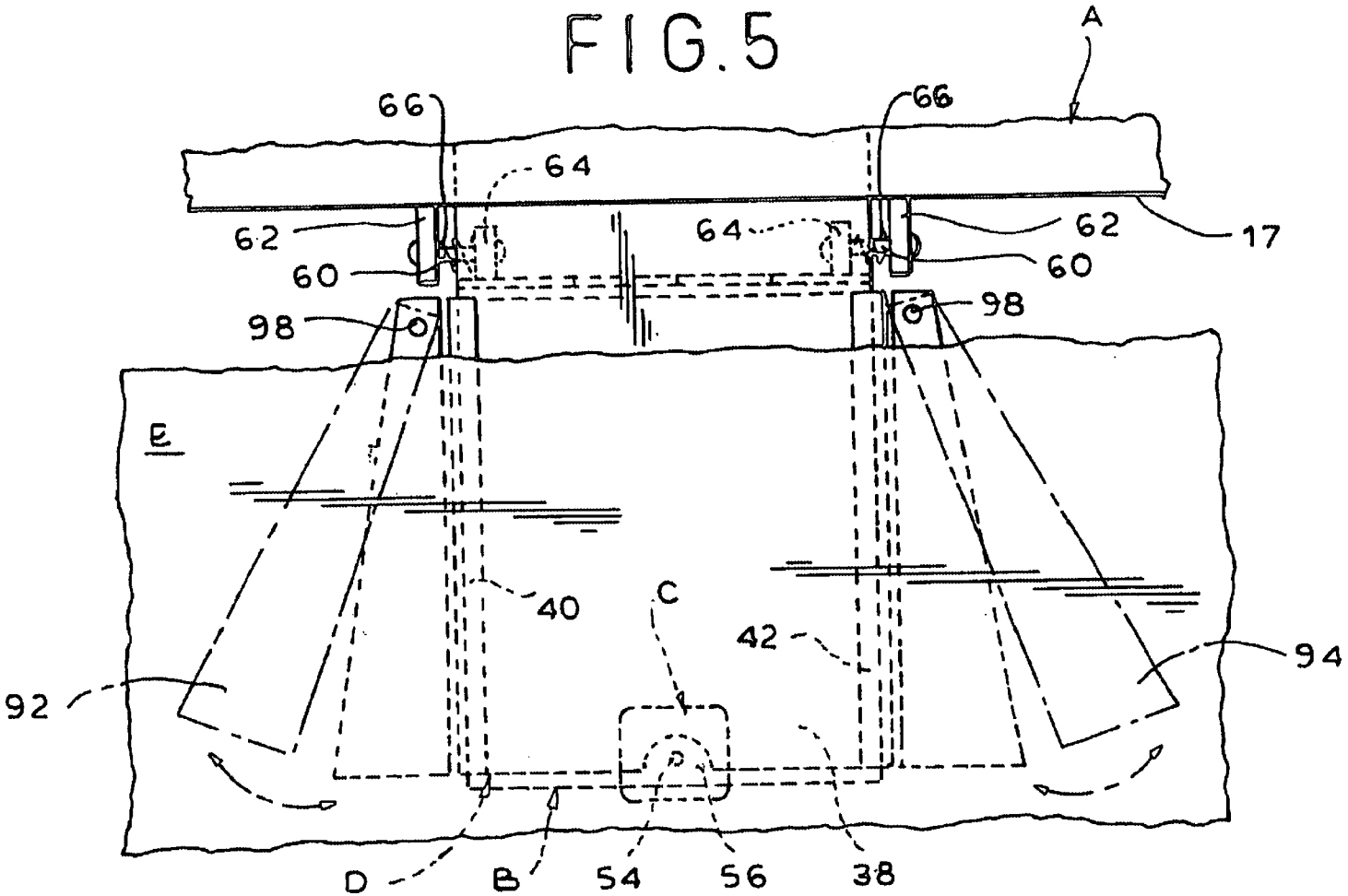
FIG. 5 is a top elevational view of another version of the tag feed plate of the first preferred embodiment.
Figure 6:
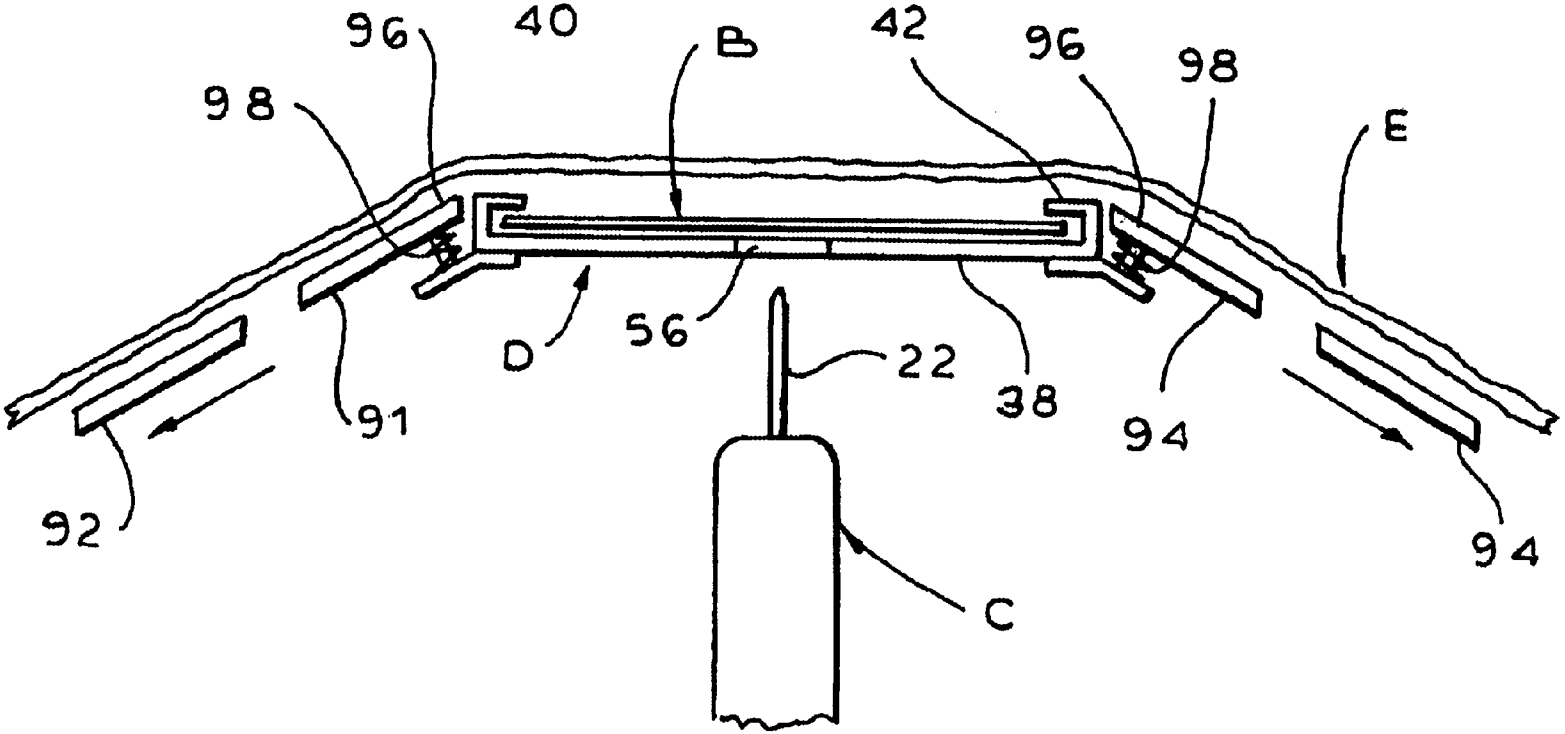
FIG. 6 is a front view of the plate of FIG. 5.

Whether the article is situated over plate D, as in the embodiment of FIG. 1 or under the plate, as in the embodiment of FIG. 2, it is important that it be held taught when it is penetrated by the needle. This can be accomplished simply by having the operator hold the ends of article in his or her hands, one on either side of plate D, with the hands spread apart. However, FIGS. 5 and 6 illustrate a first mechanism to assist in stretching the article over the feed plate.

As seen in those figures, parts 92 and 94 pivotally mounted to opposite sides of base 38 can be used to stretch the article over recess 56 in base 38. Parts 92 and 94 are spring-loaded toward base 38 by springs 96 mounted on shafts 98 which mount the parts to the base. The tops of shafts 98 are rotated outwardly and downwardly relative to base 38, as seen in FIG. 6.

The operator grasps the article at each side of base 38, along with the underlying part 92, 94 and then swings the parts outwardly and downwardly, such that the article is held taught above recess 56 in body 38. With parts 92, 94 in their remote position, plate D is moved toward its second position, such that the tag and article E are penetrated by the attacher needle.

Figure 7:
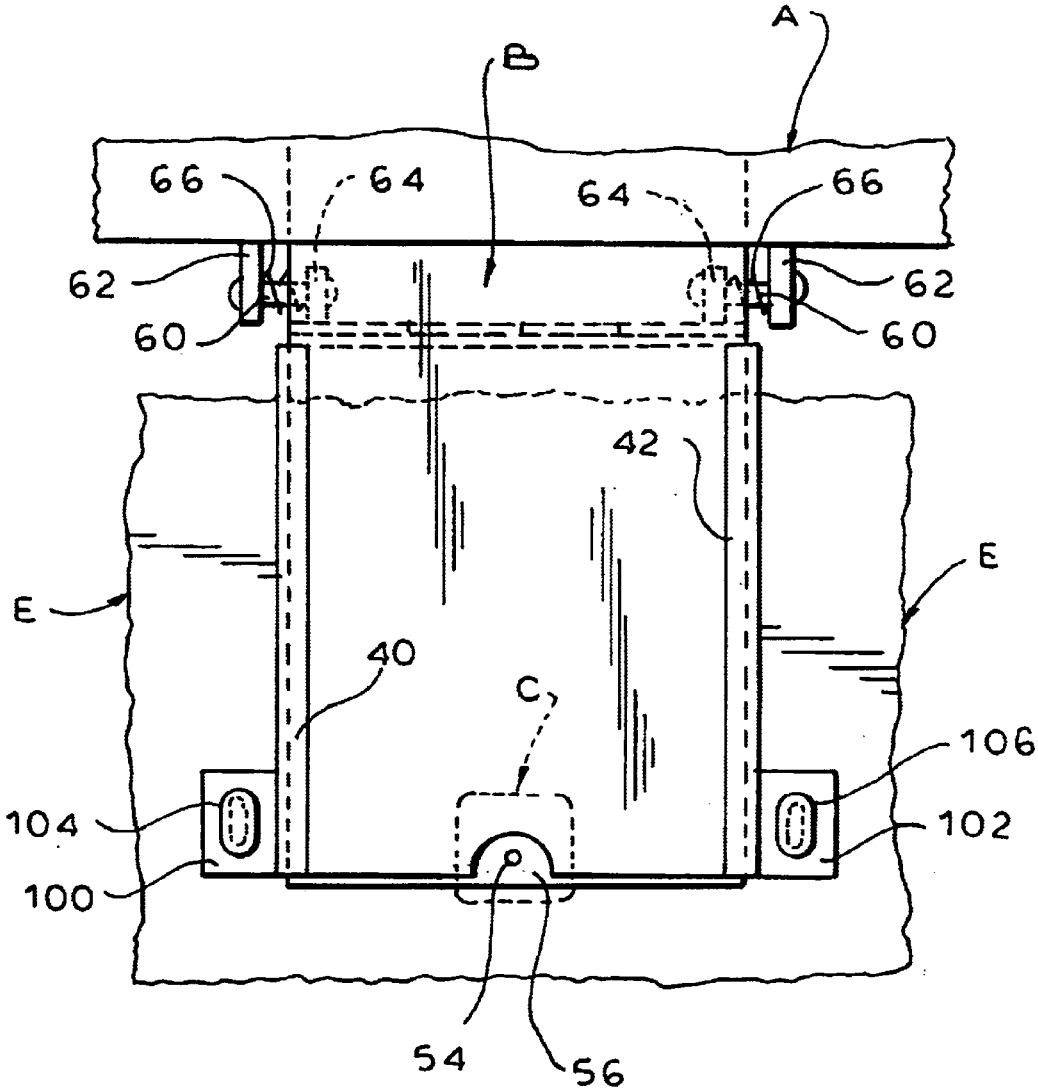
FIG. 7 is a top elevational view of another version of the tag feed plate of the second embodiment.
Figure 8:
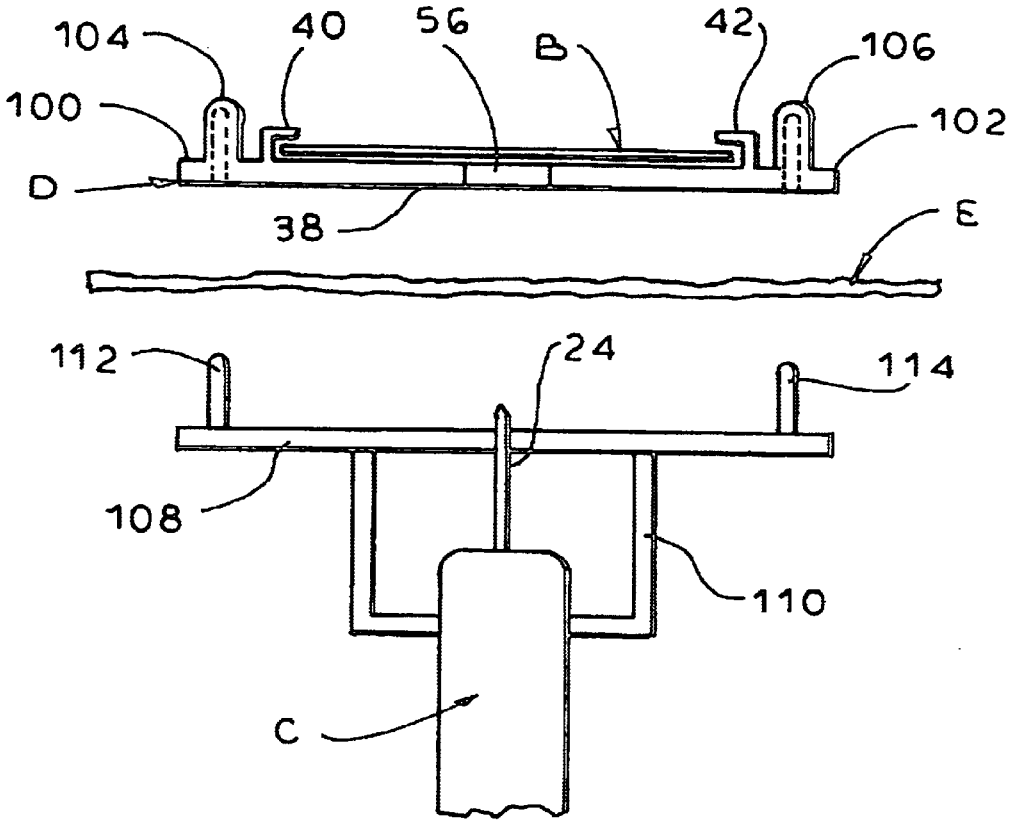
FIG. 8 is a front view of the plate of FIG. 7.

A different mechanism for this purpose, usable with the second preferred embodiment, in which the article is located below plate D, is shown in FIGS. 7 and 8. This mechanism includes parts 100, 102 fixed to either side of base 38. Each part 100, 102 includes an upstanding hollow protrusion 104, 106, respectively.

A part 108 is mounted on attacher C by a bracket 110. Part 108 carries two protrusions 112, 114, one on either side of needle 22, which align with the recesses in protrusions 104, 106, respectively. As plate D is moved downwardly toward the needle, article E is also pushed downwardly and engaged by the tips of protrusions 112, 114. As the plate moves further, protrusions 112 and 114, with the aligned sections of article E, are received in the recesses of protrusions 104 and 106, respectively, stretching article E and holding it taught as it is penetrated by the needle.

It will now be appreciated that the present invention relates to apparatus for automatically attaching tags to articles which employs a simplified tag feed mechanism in the form of a pivotally mounted spring-loaded tag feed plate. The plate receives the printed tag from the tag dispenser. The plate, with its tag, and the article to be tagged, are moved together, either manually or by action of a pneumatic cylinder, toward an attaching device such that the needle penetrates the article and the tag at the same time. The attacher is actuated to dispense a fastener through the needle. The spring-loading of the plate then urges the plate away from the needle, allowing the article with its anchored tag to be removed, once the plate clears the needle. The tag dispenser is then actuated to dispense the next printed tag.

While only a limited number of preferred embodiments of the invention have been disclosed for purposes of illustration, it is obvious that many variations and modifications could be made thereto. It is intended to cover all of these variations and modifications which fall within the scope of the invention, as defined by the following claims.

I claim:

1. Automatic apparatus for attaching a tag to an article comprising a tag attacher with a hollow needle through which a fastener is dispensed, upon actuation of said Lag attacher; pivotally mounted means for receiving a tag, the article to be tagged being situated adjacent said tag receiving means, said tag receiving means, tag and article being moveable between a first position, wherein the tag and article are aligned with but spaced from said attacher needle and a second position, wherein the tag and article are positioned on said attacher needle, prior to actuation of said attacher.

2. The apparatus of claim 1 further comprising means for springloading loading said tag receiving means towards said first position.

3. The apparatus of claim 1 further comprising means for dispensing tags, one at a time, to said tag receiving means.

4. The apparatus of claim 3 wherein said tag dispensing means comprises tag printing means.

5. The apparatus of claim 4 wherein said tag printing means comprises a housing with a surface proximate the location where the tags are dispensed, said tag receiving means being mounted on said surface.

6. The apparatus of claim 4 wherein said tag printing means comprises means for receiving a continuous roll of tags to be printed, said tags being connected together end-to-end.

7. The apparatus of claim 6 further comprising means for connecting said tags to each other such that the tags are separable without cutting.

8. The apparatus of claim 1 further comprising means for moving said tag receiving means toward said second position.

9. The apparatus of claim 1 wherein said first position of said tag receiving means is in a plane which forms an acute angle with a plane substantially perpendicular to said needle.

10. The apparatus of claim 9 wherein said second position is in a plane which forms an acute angle with the plane of said first position.

11. The apparatus of claim 1 wherein said first position of said tag receiving means is in a plane substantially perpendicular to said needle.

12. The apparatus of claim 11 wherein said second position is in a plane which forms an acute angle with the plane of said first position.

13. The apparatus of claim 1 further comprising means for holding the article taught as it is placed on said needle.

14. The apparatus is claim 13 wherein the article to be tagged is located above said tag receiving means.

15. The apparatus of claim 14 wherein said tag receiving means comprises a tag receiving section, and wherein said holding means comprises article stretching means situated proximate to and moveable away from said tag receiving section such that the article is stretched over said tag receiving section.

16. The apparatus of claim 15 wherein said stretching means comprises first and second parts, situated proximate the opposite sides of said tag receiving section and being moveable away from said tag receiving section such that the article is stretched over said tag receiving section.

17. The apparatus of claim 13 wherein the article to be tagged is located below said tag receiving means.

18. The apparatus of claim 17 wherein said tag receiving means comprises a tag receiving section and wherein said holding means comprises article stretching means comprising first and second recesses located on said tag receiving means, on opposite sides of said tag receiving section, and a part having first and second protrusions, said first and second protrusions being aligned with said first and second recesses, respectively.

19. The apparatus of claim 18 wherein said part is situated proximate said attacher, with said first and second protrusions located on opposite sides of said needle.

20. The apparatus of claim 1 further comprising means for actuating said attacher located to sense the position of said tag receiving means, such that said attacher is actuated to dispense a fastener as said tag receiving means approaches said second position.

* * * * *